US011149456B2

(12) United States Patent
McDuffie

(10) Patent No.: US 11,149,456 B2
(45) **Date of Patent: *Oct. 19, 2021**

(54) POOL PERIMETER AND WATER AGITATOR SYSTEM AND ASSEMBLY

(71) Applicant: Paddock Pool Equipment Company, Rock Hill, SC (US)

(72) Inventor: Michael McDuffie, Fort Mill, SC (US)

(73) Assignee: PADDOCK POOL EQUIPMENT COMPANY, Rock Hill, SC (US)

( * ) Notice: Subject to any disclaimer, the term of this patent is extended or adjusted under 35 U.S.C. 154(b) by 139 days.

This patent is subject to a terminal disclaimer.

(21) Appl. No.: 16/704,120

(22) Filed: Dec. 5, 2019

(65) Prior Publication Data

US 2021/0172187 A1 Jun. 10, 2021

(51) Int. Cl.
*E04H 4/12* (2006.01)
*B05B 17/08* (2006.01)
*E04H 4/00* (2006.01)

(52) U.S. Cl.
CPC ..... *E04H 4/12* (2013.01); *B05B 17/08* (2013.01); *E04H 4/0006* (2013.01)

(58) Field of Classification Search
CPC ..... E04H 4/12; E04H 4/0006; E04H 4/1227; E04H 4/14; B05B 17/08
USPC ... 4/506, 488, 507, 508, 509, 510, 511, 512, 4/513
See application file for complete search history.

(56) References Cited

U.S. PATENT DOCUMENTS 2,785,545 A * 3/1957 Pusey ..... F25D 17/02 62/392
3,682,311 A 8/1972 Bishop
3,829,911 A 8/1974 Bishop
3,941,154 A 3/1976 Bishop
4,059,856 A 11/1977 Patterson
4,080,670 A 3/1978 van den Broek
5,359,744 A * 11/1994 Kimball ..... D06F 39/024 8/158
5,930,850 A 8/1999 Baker
10,697,190 B2 * 6/2020 McDuffie ..... E04H 4/1227
10,774,555 B2 * 9/2020 Baker ..... E04H 4/1227
2019/0316372 A1 10/2019 Baker
2020/0299986 A1 * 9/2020 Huang ..... E04H 4/1672
2021/0140085 A1 * 5/2021 Chupka ..... D06F 13/02

FOREIGN PATENT DOCUMENTS

FR 2304751 A1 1/1976

* cited by examiner

*Primary Examiner* — Lori L Baker

(74) *Attorney, Agent, or Firm* — Greer, Bums & Crain, Ltd.

(57) ABSTRACT

An agitator system for a diving station that directs water flow from the perimeter of a pool onto a water surface of the pool, where the agitator system is connected to a pool perimeter assembly having a return conduit for receiving pressurized water, and the return conduit has at least one return outlet, includes a spray port and a fluid delivery system. The spray port is located on the pool perimeter assembly and is configured for directing a water spray onto the water surface of the pool. The fluid delivery structure is in downstream fluid communication from the return conduit and in upstream fluid communication with the spray port. A first portion of the pressurized water in the return conduit is communicated to the spray port via the fluid delivery structure, and a second portion of the pressurized water is delivered to the return outlet for dispersing to the pool.

20 Claims, 7 Drawing Sheets

POOL PERIMETER AND WATER AGITATOR SYSTEM AND ASSEMBLY

FIELD OF THE DISCLOSURE

This disclosure relates to systems and devices installed around a pool perimeter. More particularly, this disclosure relates to agitator systems and assemblies installed at a pool perimeter for spraying water to agitate a water surface of the pool.

BACKGROUND

Agitator systems and assemblies are devices that spray water onto a pool surface to agitate the pool water. The agitator assembly is installed at the pool perimeter under a starting platform, diving platform or springboard, and sprays water onto the pool surface to break up the reflection of overhead light, allowing divers to better see the water surface. Conventional agitator systems and assemblies are fed with tap water via plumbing that are separate from the pool water system. Over time, plumbing systems are susceptible to leaks, and the incorporation of a secondary plumbing system for the agitator assembly increases the chances of leaks occurring over the lifetime of the pool.

BRIEF SUMMARY OF THE DISCLOSURE

An agitator system for a diving station that directs water flow from the perimeter of a pool onto a water surface of the pool, where the agitator system is connected to a pool perimeter assembly having a return conduit for receiving pressurized water, and the return conduit has at least one return outlet, includes a spray port and a fluid delivery system. The spray port is located on the pool perimeter assembly and is configured for directing a water spray onto the water surface of the pool. The fluid delivery structure is in downstream fluid communication from the return conduit and in upstream fluid communication with the spray port. A first portion of the pressurized water in the return conduit is communicated to the spray port via the fluid delivery structure, and a second portion of the pressurized water is delivered to the return outlet for dispersing to the pool.

A pool perimeter assembly that is connected to a pool filtration system and that is adjacent to a pool having a water surface includes a return conduit, a gutter conduit and a pool agitator assembly. The return conduit is in fluid communication with the pool filtration system for receiving filtered water under pressure. The return conduit has at least one return outlet for dispersing the filtered water to the pool. The gutter conduit is adjacent the return conduit and is in fluid communication to deliver water to the filtration system. The pool agitator assembly is disposed in the gutter conduit and has a spray port and a fluid delivery structure in downstream fluid communication from the return conduit and in upstream fluid communication from the spray port. The spray port emits a spray of filtered water onto the water surface of the pool.

A method of directing fluid flow from a pool filtration system to the perimeter of a pool and onto a water surface of a pool includes the step of providing a return conduit to communicate pressurized water from the pool filtration system. The method further includes the steps of drawing off a portion of the pressurized water from the return conduit, conveying the portion of the pressurized water with a fluid delivery structure to a spray port disposed adjacent the perimeter of the pool, and spraying the pressurized water onto the surface of the pool.

Further objects and advantages of the invention will become apparent from the following detailed description when read in conjunction with the accompanying drawings.

DETAILED DESCRIPTION

Figure 1:
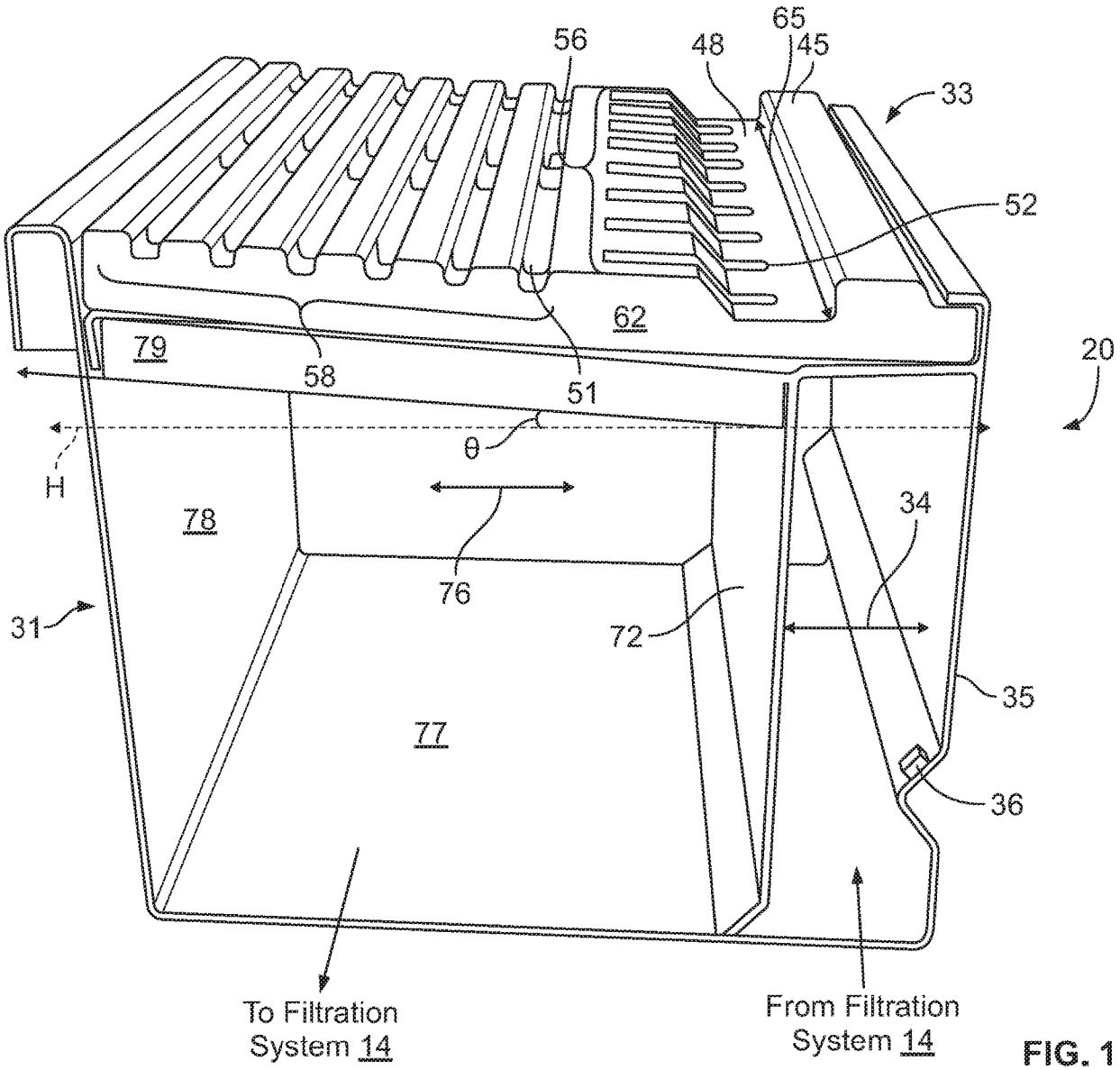
FIG. 1 is a side cross section view of a pool perimeter assembly having a return conduit and a gutter conduit for installation around a pool.
Figure 3:
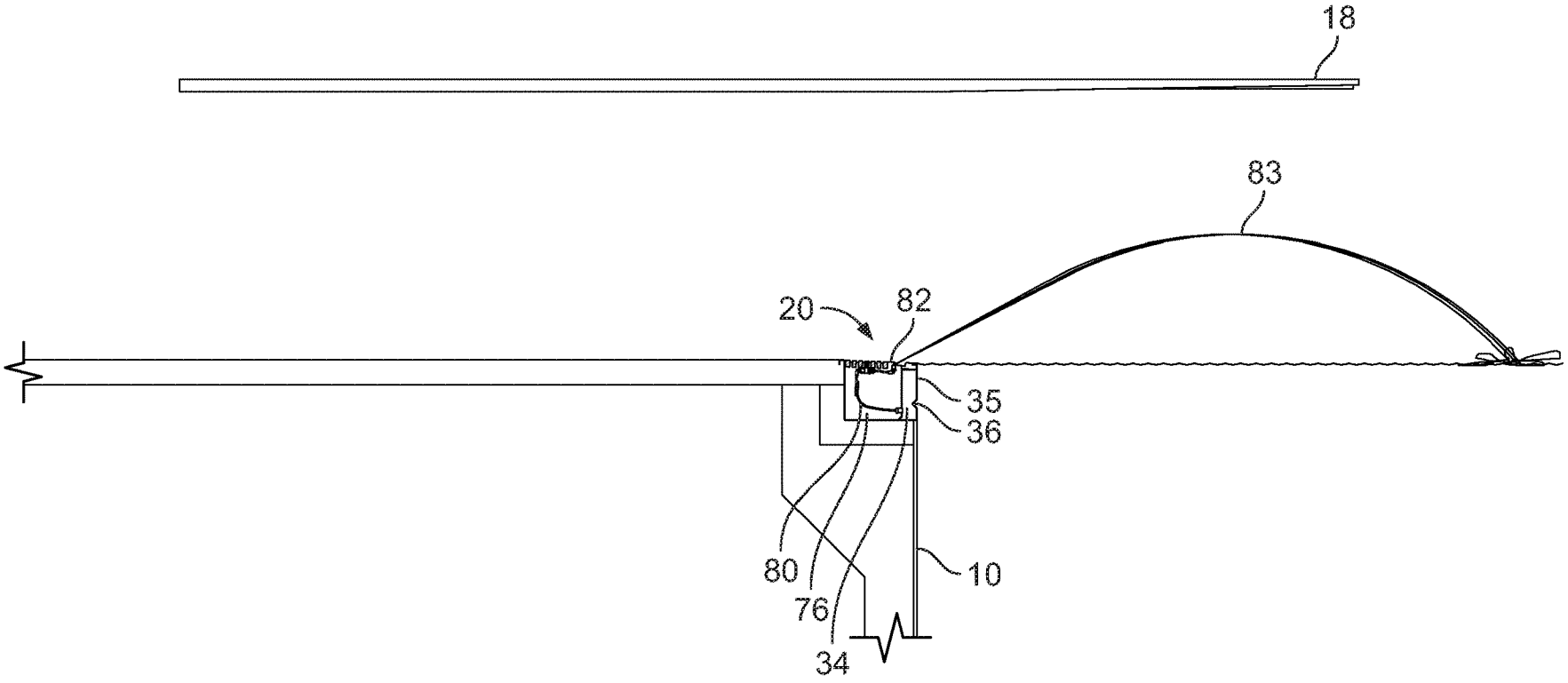
FIG. 3 is a side cross section view of a pool perimeter assembly installed at a pool wall including the pool agitator assembly of FIG. 2 and showing the direction of water flow emitted from the agitator assembly with respect to a diving springboard and onto the water surface of the pool.

FIG. 1 illustrates a pool perimeter assembly (20) for installing along a pool perimeter wall. The pool perimeter assembly (20) includes conduits formed by pool-facing sidewall (35), which is located above the pool side wall (10) (seen in FIG. 3), interior sidewalls (72, 78), a horizontal base (77), and a grate (62). One of the conduits is a deck drain gutter conduit, herein "gutter conduit" (76), that receives back-splashed or overflow water from the pool or water from an adjacent pool deck. A second of the conduits is a filtered water return conduit, herein "return conduit" (34), that replenishes the pool with filtered water in an ongoing filtration system (14). The return conduit (34) and the gutter conduit (76) are fluidly sealed from each other within the pool perimeter assembly (20), but are in fluid communication via the filtration system (14). A conventional filtration system (14) directs the back-splashed water from the pool and collects it in the gutter conduit (76). The water is then directed into various components, such as for example, a surge tank, a strainer, a pump, filters, filtered water return lines, etc. (not shown), that collectively meet regulatory requirements for clean liquids/water in the pool. After filtration, the water is returned to the return conduit (34) under pressure, where it is dispersed to the pool at a series of return outlets (36). The pressure in the return conduit is typically from about 5 psi to about 8 psi above atmospheric. The return conduit is fitted with at least one but typically multiple return nozzles or outlets (36) located on the pool perimeter wall below the desired water level in the pool, however other locations are contemplated.

Figure 2:
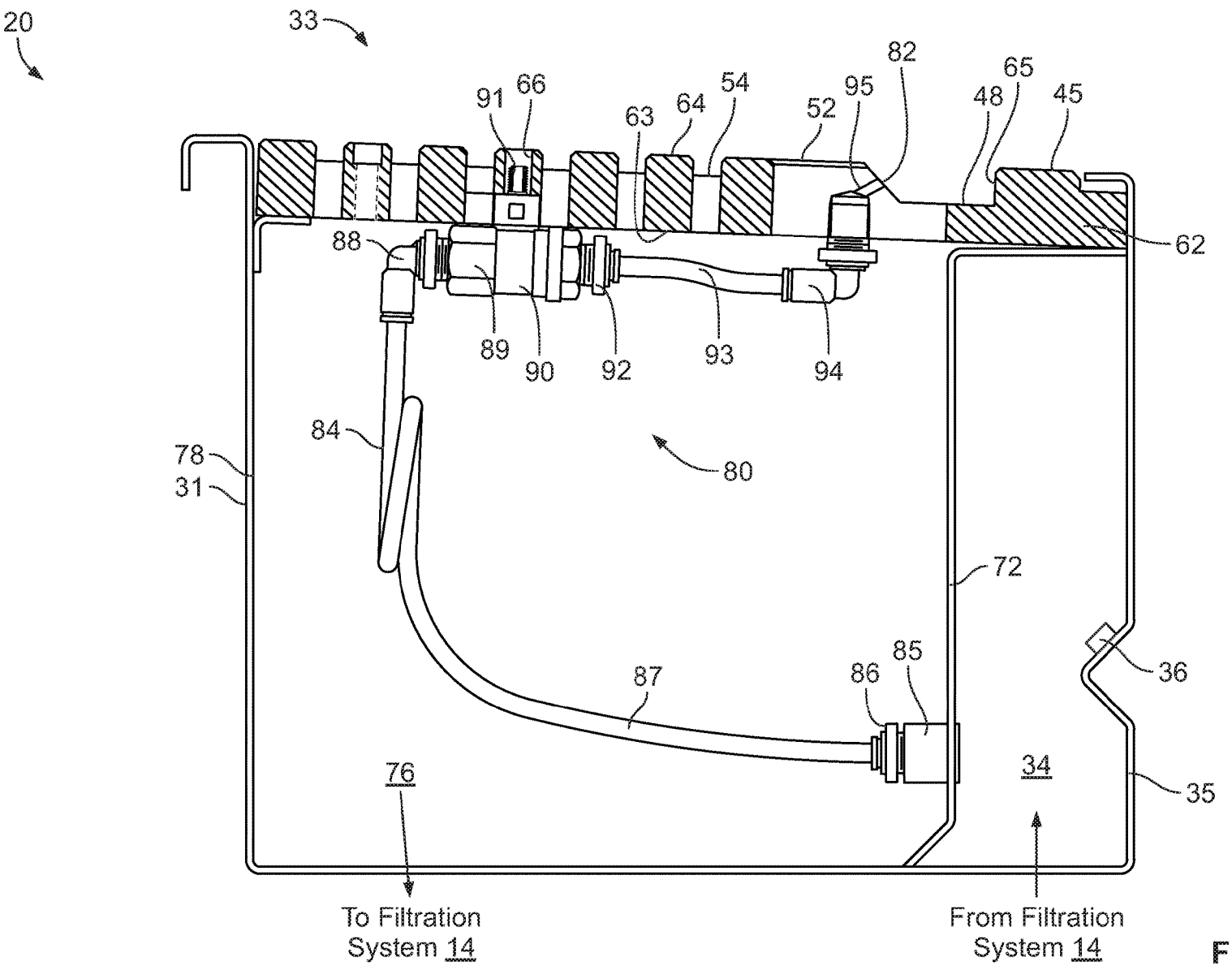
FIG. 2 is a side cross section view of a pool perimeter assembly having a return conduit and a gutter conduit, and a pool agitator assembly disposed within the pool perimeter assembly.

Referring now to FIG. 2, one embodiment of a pool agitator assembly (80) is disposed in the interior of the pool perimeter assembly (20). While the present description of the pool perimeter assembly (20) and pool agitator assembly (80) is referenced for use with "fluid" or "water", it is to be understood that these terms refer to water used in a swimming pool. The pool perimeter assembly (20) has a gutter assembly (33) as best seen in FIG. 1, and the pool agitator assembly (80) is preferably located thereunder. The pool perimeter assembly (20) is shown as incorporating two conduits—a return conduit (34) and a gutter conduit (76) into which backsplash from the pool and/or excess water collecting on a deck surrounding the pool enters through a grate (62) of the gutter assembly (33). The grate (62) defines drain ports (52) aligned about the grate surface in a series (56), and optionally, another series (58) of different grate ports (54) that may be oriented in a different direction (best seen in FIG. 1). The distinct series (56, 58) of grate ports (52, 54) are perpendicular to one another, but other respective directions are equally available for manufacture. The grate (62) is characterized in part by defining a hand-hold section (65) that defines a convenient grip for a person's hand when that person is in the pool and proximate the perimeter assembly.

The hand hold section (65) may be divided into components including the grip (45) rising above a recess (48). The hand-hold section (65) is further configured for installation with the hand-hold section defining one of the above described series (56) of ports (52) that drain into the gutter conduit (76) (i.e., the ports (52) within the grate that are closest to the hand-hold section (65) and direct backsplashed liquid from the pool out of the hand-hold section (65), through the ports (52), and into the gutter conduit (76). The remaining ports (54) in grooves (51) of the grate (62) direct water that is splashed out of and/or beyond the hand-hold section (65) from the pool into the gutter conduit (76).

The return conduit (34) has a construction configured for installation proximate the pool and between the gutter conduit (76) and the pool. The gutter conduit (76) may have a variety of shapes and designs as needed for the installation at hand, but FIG. 2 illustrates one of such configurations in which the gutter conduit (76) is defined by sidewalls (72, 78) connected by a horizontal base (77). A support structure (79), such as that seen in FIG. 1, may also connect the sidewalls on respective ends opposite the horizontal base (77) to support the grate (62) without interfering with the ports (52, 54) opening into the gutter conduit (76).

FIGS. 1-2 illustrate another feature of the gutter assembly (33) that aids in more efficient water removal areas around a pool of liquid, such as a deck area around a swimming pool. In one embodiment, the gutter assembly (33) has a construction in which the pool-facing sidewall (35) of the return conduit (34), relative to the overall gutter assembly (33), is configured such that the grate (62) rests on the gutter assembly (33) in a position that includes an angle of incline (theta) relative to a horizontal (H) extending from a pool edge. The angle of incline is preferably 1:20 ADA cross slope. In one non-limiting embodiment of installation, a pool having a perimeter wall (FIG. 3, Ref 10) enclosing a body of liquid, supports an adjacent return conduit (34) having a pool-facing sidewall (35) proximate the pool side structure. The pool side wall typically includes a top edge defining at least one horizontal (H) axis for purposes of a point of reference herein only. In the embodiment of FIG. 2, the grate (62) rests on the gutter assembly (33) such that the grate (62) is elevated along a surface (31) opposite the water return conduit (34). Such assembly provides additional back splash capacity without restricting use of an associated deck. In one non-limiting embodiment, there is a ¾-inch to one-inch difference in elevation, relative to horizontal (H) from the pool side (i.e., the pool-facing sidewall (35) of the return conduit (34)) to an opposite side wall (78) or outer surface (31) of the side wall particularly in regard to the base (77).

In terms of construction, the return conduit (34) has at least one and preferably multiple return outlets (36) in the pool-facing sidewall (35) connected or directly proximate a perimeter wall of a pool (FIG. 3, Ref. 10) to emit and return the filtered water back to the pool. The return outlet (36) may be nozzles, jets or other water emitting structures known in the art. In a preferred embodiment, the return conduit (34) and the gutter conduit (76) are fabricated of stainless steel, however other materials are contemplated.

Referring to FIGS. 2-5, the pool water surface agitator assembly is indicated generally at (80) and is in fluid communication downstream of the return conduit (34). The agitator assembly (80) comprises a spray port (82) and a fluid delivery structure (84) that diverts a small portion of the recirculated water from the return conduit (34) to the spray port (82) to spray water onto the pool water surface (see FIG. 3). A second and primary portion of the filtered water from the return conduit (34) is emitted to the pool via the return outlets (36).

Fluid communication between the return conduit (34) and the spray port (82) is accomplished by providing a fluid delivery structure (84) of the agitator assembly (80) that may include tubes, hoses, fittings and valves, among other structures that are configured to sealingly deliver water from the return conduit to the spray port. In the preferred embodiment shown in FIG. 2, which should not be construed as limiting, the fluid delivery structure (84) includes a coupling (85) and fitting (86) attached to a sidewall (72) of the gutter conduit (76), which allows fluid communication from the return conduit (34) to tubing (87). In downstream fluid communication of the tubing (87) is a second fitting (88) and valve (89) for selectively opening the fluid delivery structure (84) to permit fluid flow through the valve and to emit water from the spray port (82). The valve (89) may be attached to the grate (62) at an interior surface (63) of the grate with a U-clamp (90), although other locations and connectors are contemplated. The U-clamp may be received in the interior surface (63) and affixed with a fastener (91) fed through an opening (66) through the grate (62) from the exterior surface (64) of the grate. From the valve (89), a third fitting (92) and second tubing (93) fluidly communicate with a fourth fitting (94) that is attached to the grate (62). The fourth fitting (94) is either attached to or integrally formed with an outlet (95) of the fluid delivery structure (84). The outlet (95) is fluidly communicates with the spray port (82), as will be discussed with further detail below. The coupling (85) is preferably a stainless steel coupling, one or more of the fittings (86, 88, 92, 94) are preferably quick-connect fittings, one or more of the tubing (87, 93) is preferably a flexible tubing, the valve (89) is preferably a brass ball valve, however other materials, types and arrangements are contemplated.

The pool agitator assembly (80) uses filtered, recirculated water from the filtration system 14 that is being fed back to the pool in the return conduit (34). The water from the return conduit (34) is under positive pressure in the range of 5-8 psi above atmospheric, although a range of 3-10 psi is also contemplated. It is also possible that additional pumps may be incorporated when additional water pressure is desired.

After the pressurized water is communicated through the tubing (87), it is preferably communicated through the valve (89) that selectively permits the flow of water to the spray port (82). The valve (89) is preferably mounted on the interior surface (63) of the grate (62) with a through-bore for receiving valve stem (91) that is recessed in and accessible from the exterior surface (64) of the grate. In the preferred embodiment, there is one valve (89) for each agitator assembly (80), however other configurations are contemplated. The valve (89) may be operated mechanically by engaging a screwdriver, Allen wrench or other tool with valve stem (91). Alternatively, the valve may be operated with an electronic control either at the site or remotely.

Access to the agitator assembly (80) is enabled by manually lifting the grate (62) from the gutter conduit (76). Preferably, there is ample slack in the flexible tubing (87) to remove the grate (62) and expose the agitator assembly (80) for maintenance without having to disconnect the valve (89) from the grate (62). Since the interior sidewall (35) of the return conduit (34) is preferably located adjacent to or common with the perimeter wall (10) of the pool, and since the fluid delivery structure (84) of the agitator assembly (80) fluidly communicates with the return conduit instead of tap water on a separate plumbing system, the components of the agitator assembly are readily accessible for inspection and maintenance.

Figure 4:
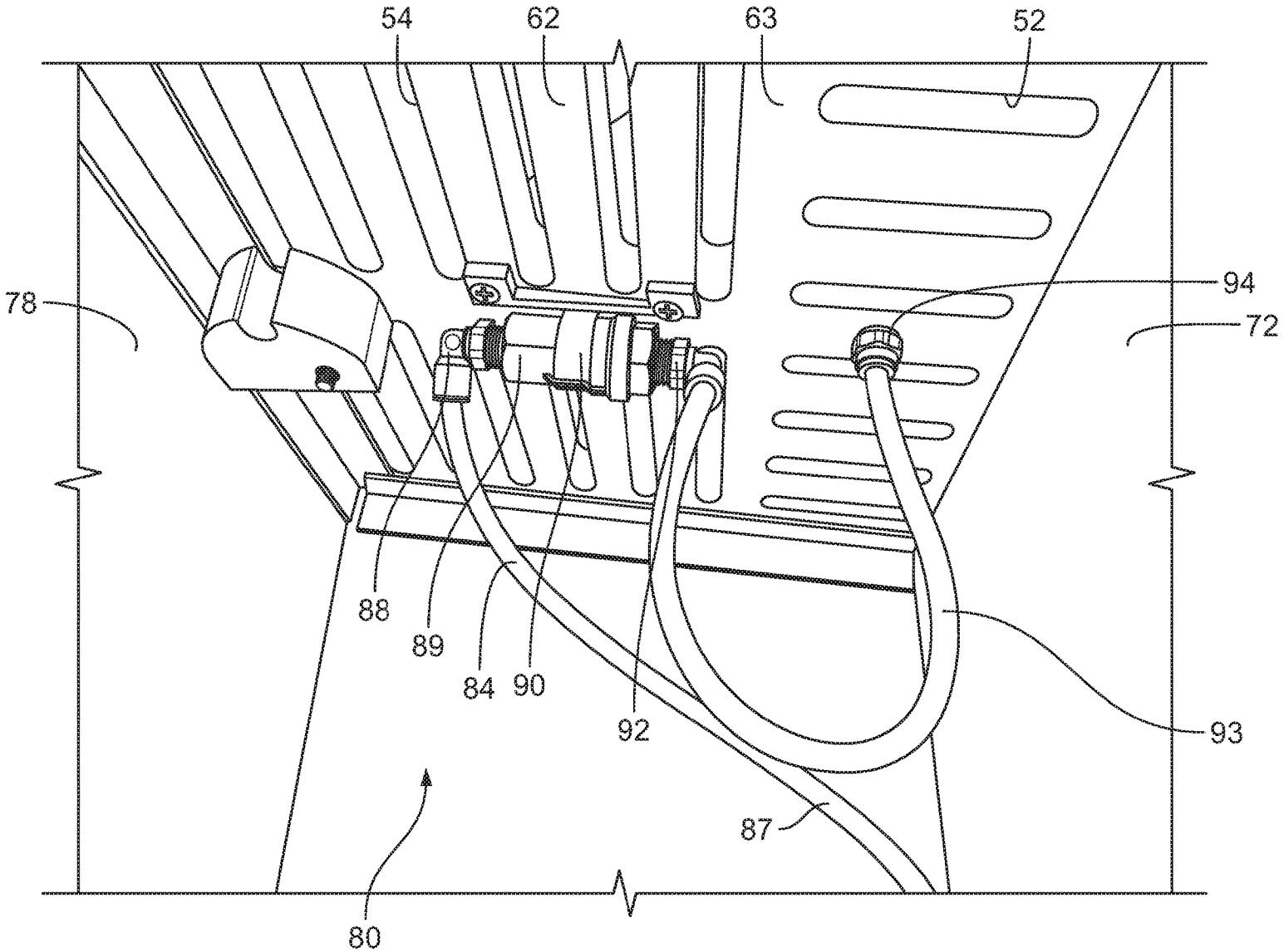
FIG. 4 is a bottom perspective view of the pool agitator assembly installed on the pool perimeter assembly of FIG. 2.
Figure 5:
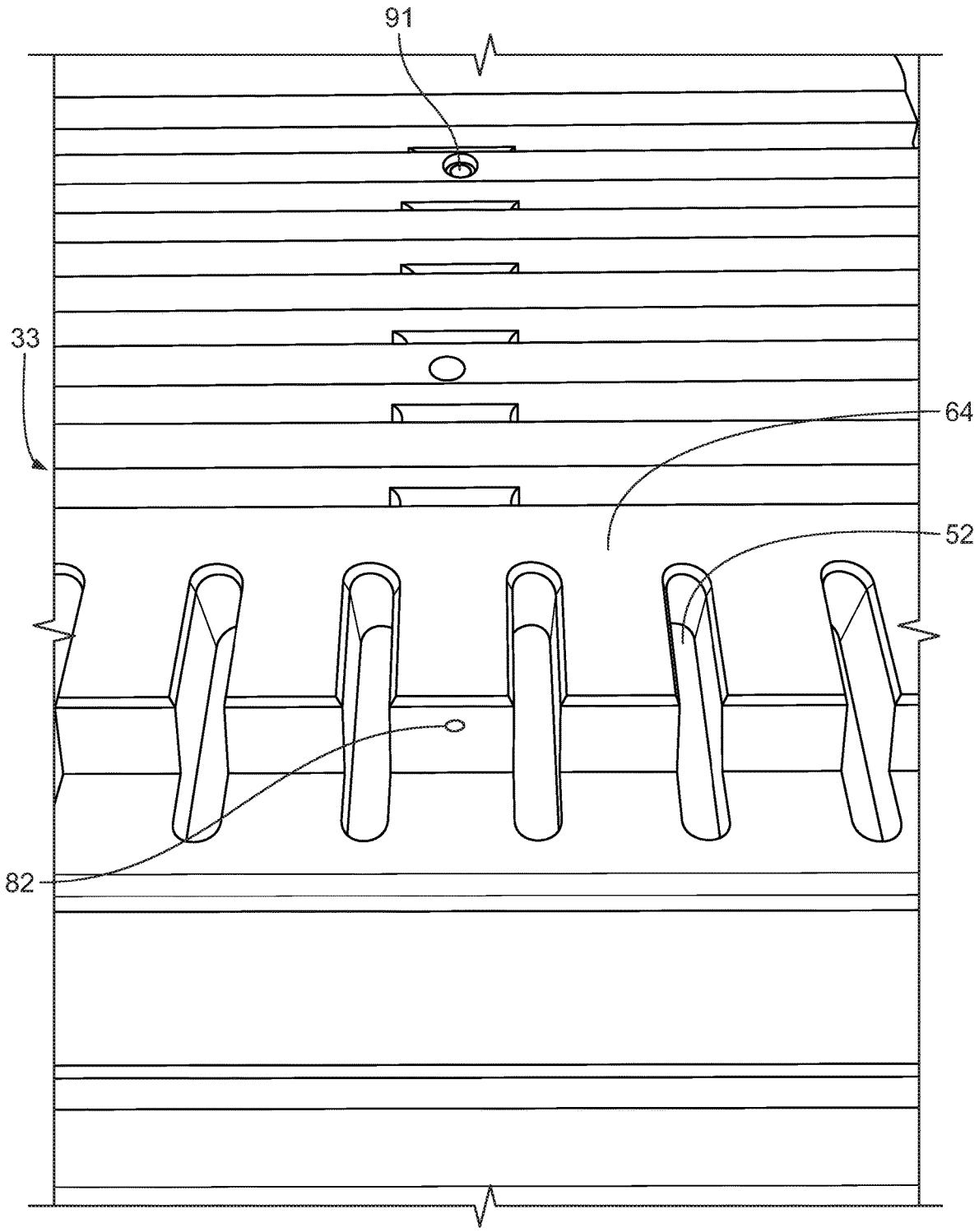
FIG. 5 is a top perspective view of the pool agitator assembly installed on the pool perimeter assembly of FIG. 2.

Referring to FIGS. 2-5, the spray port (82) is a through-bore through the grate (62), which is preferably at an angle of about 30-degrees from horizontal. While 30-degrees is most preferable, a range of 20 to 40-degrees is preferred, and a range of above 0 to below 90-degrees is possible. As seen in FIG. 4, the fourth fitting (94) that defines the outlet (95) is received in the recess in the interior surface (63) of the grate (62), which is in fluid communication with the through-bore forming the spray port (82). As seen in FIG. 5, the spray port (82) is located between two drain ports (52) on a surface of the grate (62) that is generally vertical or angled. The grate (62) is preferably made of a hard plastic, such as HDPE, however other materials are envisioned.

Figure 6:
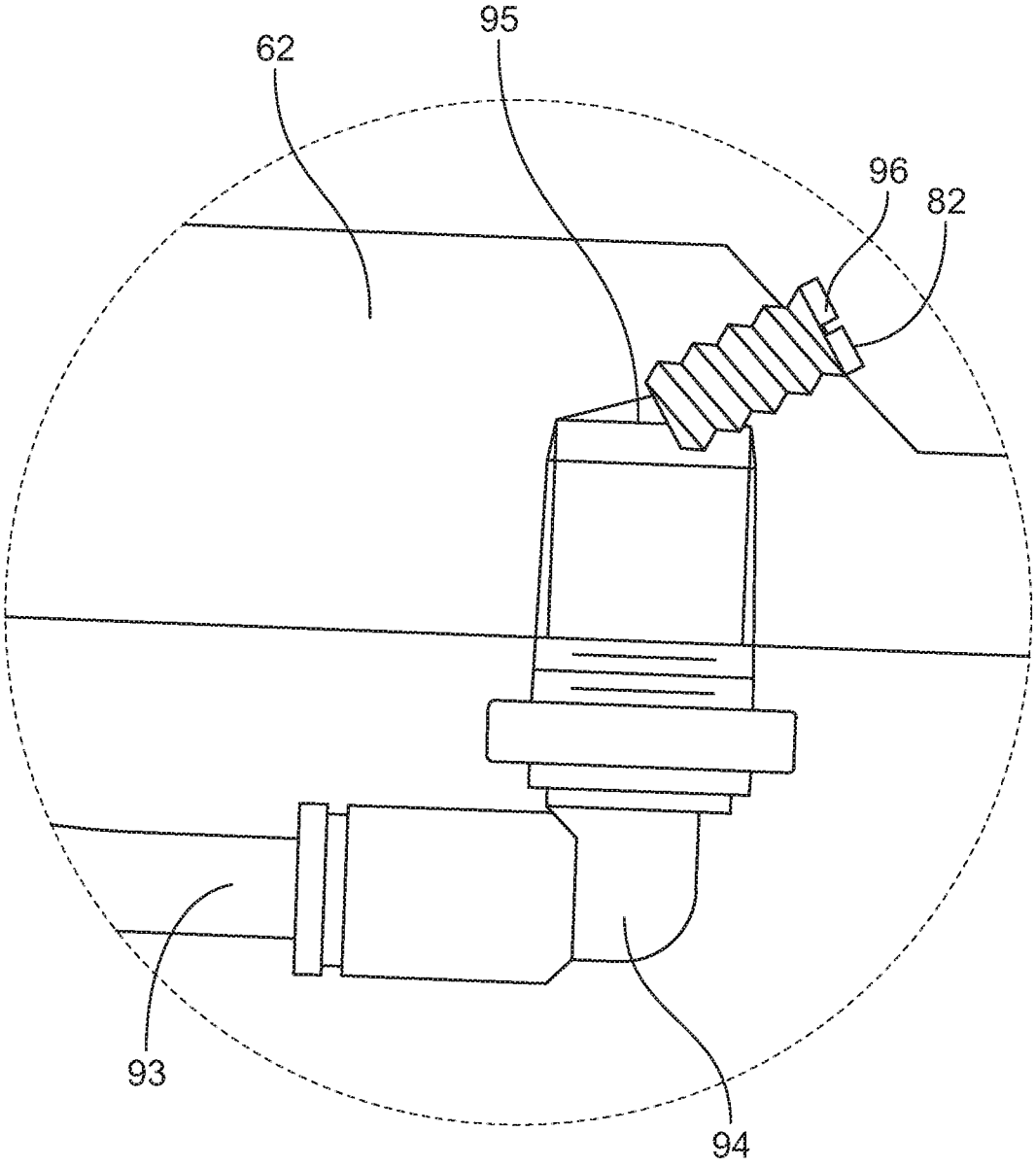
FIG. 6 is a detail cross section view of an alternate embodiment of pool agitator assembly including a nozzle.

Referring now to the embodiment of FIG. 6, the spray port (82) may optionally include a nozzle (96) that is located in the through-bore. The nozzle (96) is preferably recessed from the exterior surface (64) of the grate (62). The optional nozzle can increase control of the rate, direction, shape and/or pressure of the water stream that emerges from the nozzle (96).

Referring back to FIG. 3, it can be seen that the spray port (82) emits a stream of water (83) to the water surface of the pool adjacent a springboard/platform (18) or other apparatus, e.g., starting platform, from which a swimmer/diver enters the pool (collectively "dive station (18)"). The fluid delivery structure (84) is configured such that the water is emitted from the spray port (82) under sufficient pressure and angle to deliver the water at a distance out from the perimeter wall of the pool (10). In one preferred embodiment, the agitator assembly (80) sprays the water in an arc over a distance beyond the dive station (18) proximate to where the swimmer/diver will enter the water. The water spray agitates the surface such that a swimmer/diver can see the water surface when positioned on the dive station (18). In swimming pools designed for competitive swimming events having multiple lanes, a water surface agitator can be provided at each lane. Where the competitive swimming pool includes multiple dive stations (18), a water surface agitator assembly can be installed below each station.

Figure 7:
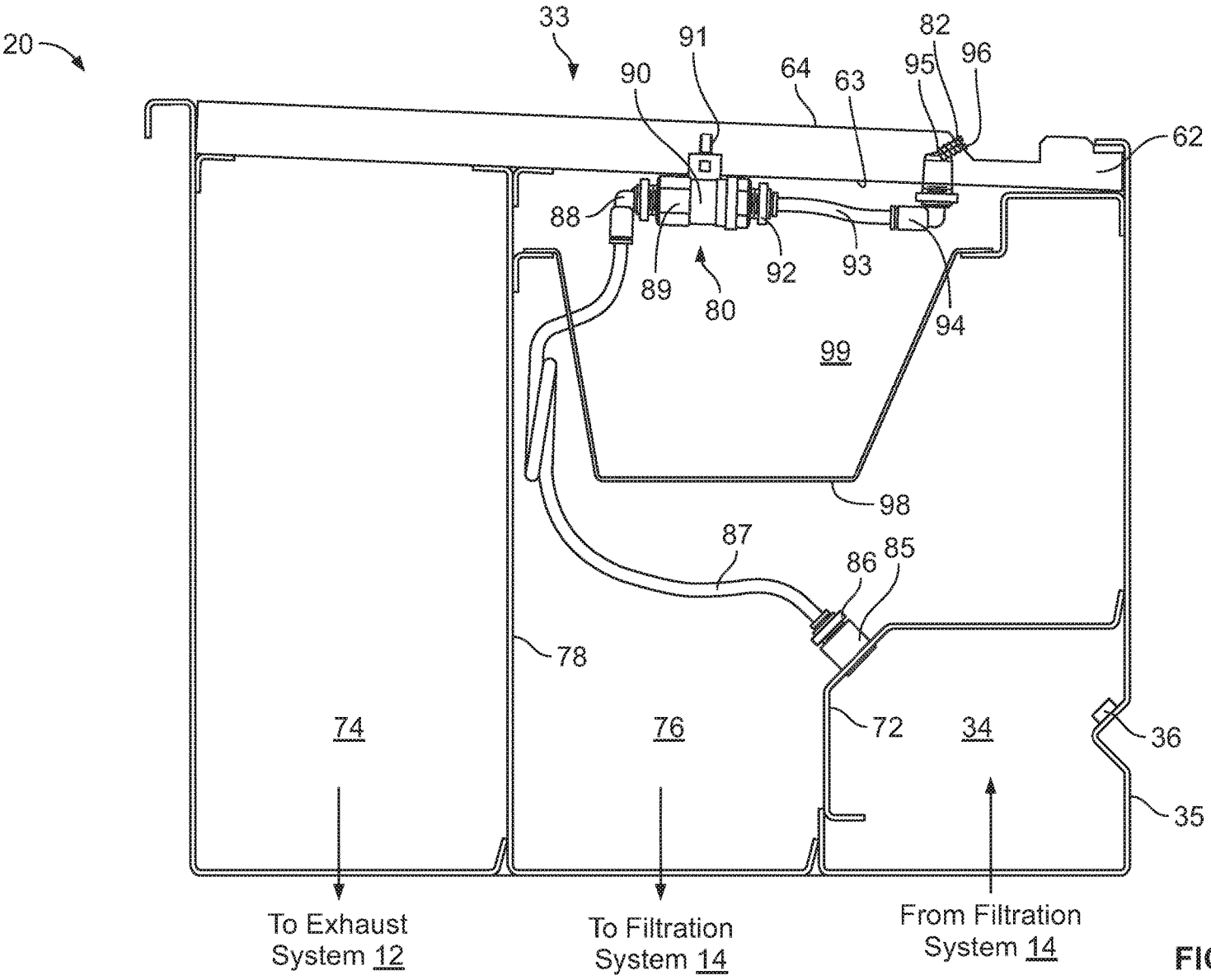
FIG. 7 is a side cross section view of an alternate embodiment of pool perimeter assembly having a return conduit, a gutter conduit, and an exhaust conduit, and the pool agitator assembly of FIG. 2 disposed within the pool perimeter assembly.

In an alternate embodiment, shown in FIG. 7, the pool perimeter assembly (20) includes a return conduit (34), a gutter conduit (76), and an air exhaust conduit (74) that draws contaminated air from the above the pool surface and removes the same via an exhaust system, herein an "exhaust conduit" (12). Such exhaust systems are disclosed in U.S. Pat. Nos. 9,540,836; 9,631,387; and 10,072,868, which are incorporated herein by reference. The pool agitator assembly (80) is similar to that in the pool perimeter assembly (20) of FIG. 2, except for an additional wall (98) that defines an upper gutter conduit (99) and lower gutter conduit (76). A portion of the fluid delivery structure, specifically, valve (89) is located in the upper gutter conduit (99) for delivering water to the spray port (82) that is also located in the upper gutter conduit.

While particular embodiments of the pool perimeter and agitator system and method have been described herein, it will be appreciated by those skilled in the art that changes and modifications may be made thereto without departing from the scope of invention as defined by the appended claims.

The invention claimed is:

1. An agitator system for a diving station configured for connection to a pool perimeter assembly that includes a return conduit for receiving pressurized water, the return conduit having at least one return outlet, the agitator system for directing water flow from the perimeter of a pool onto a water surface of the pool, comprising:

at least one spray port on the pool perimeter assembly and configured for directing a water spray onto the water surface of the pool; and a fluid delivery structure in downstream fluid communication from the return conduit and in upstream fluid communication with the spray port;

wherein a first portion of the pressurized water in the return conduit is communicated to the spray port via the fluid delivery structure, and a second portion of the pressurized water is delivered to the return outlet for dispersing to the pool.

2. An agitator system according to claim 1, wherein the fluid delivery structure includes a valve in downstream fluid communication with the return conduit and in upstream fluid communication with the spray port.

3. An agitator system according to claim 2, wherein the pool perimeter assembly further comprises a drainage grate and the valve is attached to the grate.

4. An agitator system according to claim 1, wherein the pool perimeter assembly further comprises a gutter conduit and the fluid delivery structure is located in the gutter conduit.

5. An agitator system according to claim 3, wherein the spray port includes a through-bore in the grate.

6. An agitator system according to claim 5, wherein the spray port includes a nozzle disposed within the through-bore in the grate.

7. An agitator system according to claim 1 wherein the spray port is adjacent to the diving station and oriented to direct the first portion of the pressurized water to the pool water surface in front of the diving station.

8. An agitator system according to claim 1 wherein the diving station comprises multiple diving stations, and wherein the fluid delivery structure comprises multiple fluid delivery structures, wherein a fluid delivery structure is associated with each of the diving stations.

9. An agitator system of claim 1 wherein the diving station comprises multiple diving stations, and wherein the at least one spray port comprises multiple spray ports, wherein at least one of the multiple spray ports is associated with each of the diving stations.

10. A pool perimeter assembly connected to a pool filtration system and being adjacent to a pool having a water surface, the pool perimeter assembly comprising:

a return conduit in fluid communication with the pool filtration system for receiving filtered water under pressure, the return conduit having at least one return outlet for dispersing the filtered water to the pool;

a gutter conduit adjacent the return conduit, wherein the gutter conduit is in fluid communication to deliver water to the filtration system;

a pool agitator assembly disposed in the gutter conduit, the pool agitator assembly having a spray port and a fluid delivery structure in downstream fluid communication from the return conduit and in upstream fluid communication from the spray port, the spray port emitting a spray of filtered water onto the water surface of the pool.

11. A pool perimeter assembly according to claim 10, further comprising a grate positioned over the top of the gutter conduit to direct water flow into the gutter conduit.

12. A pool perimeter assembly according to claim 11, wherein the fluid delivery structure further comprises a valve attached to the grate.

13. A pool perimeter assembly according to claim 11, wherein the spray port is in the grate and the fluid delivery structure comprises a fitting attached to the interior surface of the grate, the fitting communicating water to the spray port.

14. A pool perimeter assembly according to claim 11, wherein the spray port is defined by a through-bore in the grate.

15. A pool perimeter assembly according to claim 10, wherein the spray port is at an angle from the horizontal of 10 to 40-degrees.

16. A pool perimeter assembly according to claim 10, wherein the spray port further comprises a nozzle.

17. A pool perimeter assembly according to claim 10, further comprising an exhaust conduit configured for receiving contaminated air.

18. A pool perimeter assembly according to claim 10 wherein the return conduit extends between a pool-facing sidewall and a first interior side wall.

19. A pool perimeter assembly according to claim 18 wherein the gutter conduit is coextensive with the return conduit and fluidly sealed from the return conduit, the gutter conduit extending between the first interior sidewall and a second interior sidewall.

20. A method of agitating the water surface of a pool, the pool having a pool filtration system and a return conduit along a perimeter of the pool, the method comprising:

conveying pressurized water from the pool filtration system to the return conduit;

drawing off a portion of the pressurized water from the return conduit;

conveying the portion of the pressurized water to a spray port disposed adjacent the perimeter of the pool; and spraying the pressurized water onto the surface of the pool.

* * * * *